US010770220B2

(12) United States Patent
Vandeplassche et al.

(10) Patent No.: US 10,770,220 B2
(45) Date of Patent: Sep. 8, 2020

(54) PLANAR TRANSFORMER LAYER, ASSEMBLY OF LAYERS FOR PLANAR TRANSFORMER, AND PLANAR TRANSFORMER

(71) Applicant: THALES, Courbevoie (FR)

(72) Inventors: Philippe Vandeplassche, Bienne Lez Happart (BE); Thierry Scalais, Grace-Hollogne (BE)

(73) Assignee: THALES, Courbevoie (FR)

( * ) Notice: Subject to any disclaimer, the term of this patent is extended or adjusted under 35 U.S.C. 154(b) by 119 days.

(21) Appl. No.: 15/711,976

(22) Filed: Sep. 21, 2017

(65) Prior Publication Data

US 2018/0082777 A1 Mar. 22, 2018

(30) Foreign Application Priority Data

Sep. 22, 2016 (EP) ..... 16306215

(51) Int. Cl.

| | |
|---|---|
| ***H01F 27/28*** | (2006.01) |
| ***H01F 27/22*** | (2006.01) |
| ***H01F 27/08*** | (2006.01) |
| ***H01F 27/26*** | (2006.01) |
| ***H01F 27/32*** | (2006.01) |
| ***H01F 27/40*** | (2006.01) |

(52) U.S. Cl.

CPC ..... *H01F 27/2804* (2013.01); *H01F 27/08* (2013.01); *H01F 27/22* (2013.01); *H01F 27/26* (2013.01); *H01F 27/2847* (2013.01); *H01F 27/2852* (2013.01); *H01F 27/2876* (2013.01); *H01F 27/323* (2013.01); *H01F 27/40* (2013.01); *H01F 2027/2809* (2013.01); *H01F 2027/2819* (2013.01)

(58) Field of Classification Search

USPC ..... 336/232, 200, 192, 83, 55–61

See application file for complete search history.

(56) References Cited

U.S. PATENT DOCUMENTS

| | | | | |
|---|---|---|---|---|
| 6,278,353 | B1 * | 8/2001 | Downing | H01F 27/10 336/200 |
| 6,380,834 | B1 | 4/2002 | Canzano et al. | |
| 6,636,140 | B2 * | 10/2003 | Fujiyoshi | H01F 27/2852 336/192 |
| 2008/0079524 | A1 * | 4/2008 | Suzuki | H01F 27/22 336/61 |
| 2012/0286920 | A1 * | 11/2012 | Chen | H01B 3/10 336/233 |

FOREIGN PATENT DOCUMENTS

| | | |
|---|---|---|
| JP | 2004303823 A | 10/2004 |
| JP | 2004303857 A | 10/2004 |

* cited by examiner

*Primary Examiner* — Elvin G Enad
*Assistant Examiner* — Kazi S Hossain
(74) *Attorney, Agent, or Firm* — Baker & Hostetler LLP

(57) ABSTRACT

A planar transformer layer is provided. The planar transformer comprises distinct electrical connections and thermal connections. An assembly of layers for a planar transformer is also provided. An electronic energy conversion equipment item for a satellite provided with at least one planar transformer is also provided.

9 Claims, 6 Drawing Sheets

PLANAR TRANSFORMER LAYER, ASSEMBLY OF LAYERS FOR PLANAR TRANSFORMER, AND PLANAR TRANSFORMER

CROSS-REFERENCE TO RELATED APPLICATION

This application claims priority to foreign European patent application No. EP 16306215.1, filed on Sep. 22, 2016, the disclosures of which is incorporated by reference in its entirety.

FIELD OF THE INVENTION

The invention relates to a planar transformer layer, an assembly of layers for planar transformer, and a planar transformer.

BACKGROUND

Planar transformers are known whose power is limited to 2500 W at 300V, or to 1400 W at 2 kV.

The limiting of the power handled by a transformer involves using two to three converters each using a transformer in order to achieve a total power of 5 kW. A transformer capable of transferring 5 kW makes it possible to save on one to two converters.

The existing solutions are limited in power by:

- the effects of proximity in the transformer limit either the usage frequency or the accessible copper section;
- the thermal resistance of the transformer limits the power which can be dissipated in the transformer;
- the high output voltage entails a significant electrical insulation which is accompanied by an increase in thermal resistance; and
- the interleaving of the secondary and primary windings makes it possible to increase the frequency without reducing the copper section but also entails an increase in the electrical insulation layers which entails an increase in thermal resistance.

FIG. 1 illustrates a planar transformer according to the prior art. The right-hand part of FIG. 1 shows the materials, and the left-hand part shows the heat fluxes.

Stacked individual windings 1, in this case three of them, are made up of several layers of copper 2, in this case two of them. These layers of copper or electrical conductors 2 are electrically insulated from one another by an insulator or dielectric 3. An insulating layer or dielectric layer is disposed between each of the individual windings 1, and between the individual winding 1 at the base of the stack and a cold source on which the stack of individual windings is disposed.

Cooling such a transformer through the magnetic core requires the heat dissipated in the conductors to pass through the dielectric layers which insulate the electrical conductors from one another and which insulate the conductors from the magnetic core. Since the dielectric materials are generally poor thermal conductors, the thermal resistance between the hot point of the conductors and the magnetic core is high (the thermal resistances of each dielectric layer are connected in series from the hot point to the magnetic core). Furthermore, since the magnetic core is also a source of heat dissipation, it does not represent a good cold source.

The use of the electrical connections as cold source makes it possible to cool the electrical conductors without passing through the series of dielectric layers. When the transformer is connected to a busbar, the heat can be removed by convection. When convection is not possible, the busbar is itself electrically insulated and does not therefore represent a good cold source.

An increase of the output voltage of such a transformer would entail increasing the thickness of insulation and consequently increasing the thermal resistance. The increase in thermal resistance would entail reducing the power transferrable through the transformer. To maintain the transferred power, it would be necessary to increase the volume and the weight of the transformer which would pose problems of resistance to the thermomechanical environment, which would lead an acceptable limit in terms of the weight and the volume of the current designs to be exceeded. Doubling the transferred power is therefore inconceivable with the known embodiments.

Furthermore, such a transformer has to operate in a vacuum which prevents the cooling by convection.

SUMMARY OF THE INVENTION

One aim of the invention is to produce a transformer for transmitting an electrical power of at least 5 kW with a galvanic insulation under an output voltage of 300 V to 2 kV in order to power an ion thruster for satellite or space probe.

There is proposed, according to one aspect of the invention, a planar transformer layer comprising distinct electrical connections and thermal connections.

Thus, it is possible to significantly improve the discharging of thermal energy, and produce a planar transformer capable of transmitting an electrical power of at least 5 kW with a galvanic insulation under an output voltage of 300 V to 2 kV in order to power an ion thruster for satellite or space probe.

In one embodiment, a thermal connection comprises a hole.

Such a hole allows an element such as a screw to hold a plurality of layers together.

According to one embodiment, such a hole comprises an extension towards the interior of the layer.

Such an extension towards the interior of the layer makes it possible to maximize the exchange surface between the layer and the heat sink.

As a variant, a thermal connection can be comb-shaped.

Thus, the exchange surface between the layer and the heat sink is increased.

According to another aspect of the invention, there is also proposed an assembly of layers for planar transformer, comprising at least one primary planar transformer layer as previously described, and two secondary planar transformer layers without distinct electrical and thermal connections, the three layers being separated and covered by a dielectric material, except for the thermal connection or connections of the planar transformer layer as previously described.

Such an assembly of layers offers a minimal thermal path between the secondary layers and the primary layer, the assembly being thermally drained by the access from the primary layer to the heat sink. This assembly is particularly advantageous when the electrical insulation between secondary layers and heat sink is difficult to guarantee.

According to another aspect of the invention, there is also proposed a planar transformer comprising at least one assembly as previously described.

In one embodiment, a transformer comprises a plurality of assemblies stacked one on top of the other, in which the thermal connections of the primary layers are connected to a heat sink.

Thus, each assembly is individually drained. The assembly of the layers of the transformer is cooled by as many connections to the heat sink in parallel which improves the draining compared to a series connection.

According to one embodiment, the heat sink comprises a cold source and a dielectric part.

Thus, the dielectric part ensures the electrical insulation between the heat sink and the layers. By placing in the heat sink the layers requiring the lowest dielectric withstand strengths in relation to the heat sink, the choice of the dielectric is widened, authorizing the optimization of the thermal conductivity, and the thickness of dielectric separating the layer and heat sink can be minimized to maximize the thermal conductivity between layer and sink.

In one embodiment, the cold source is disposed on the outer part of the heat sink, surrounding the dielectric part.

According to one embodiment, the planar transformer further comprises a magnetic core and an associated fixing element.

Also proposed, according to another aspect of the invention, is an electronic energy conversion equipment item for satellite provided with at least one planar transformer as previously described.

BRIEF DESCRIPTION OF THE DRAWINGS

The invention will be better understood on studying a few embodiments described as nonlimiting examples and illustrated by the attached drawings in which.

In the different figures, the elements that have the same references are identical.

DETAILED DESCRIPTION

Figure 1:
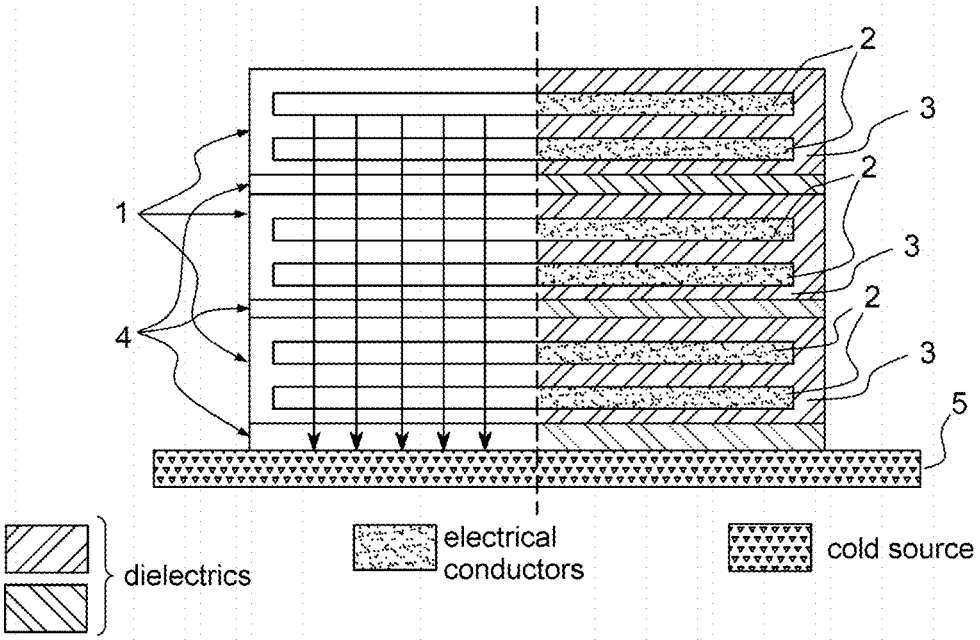
FIG. 1 schematically illustrates a planar transformer according to the prior art.
Figure 2:
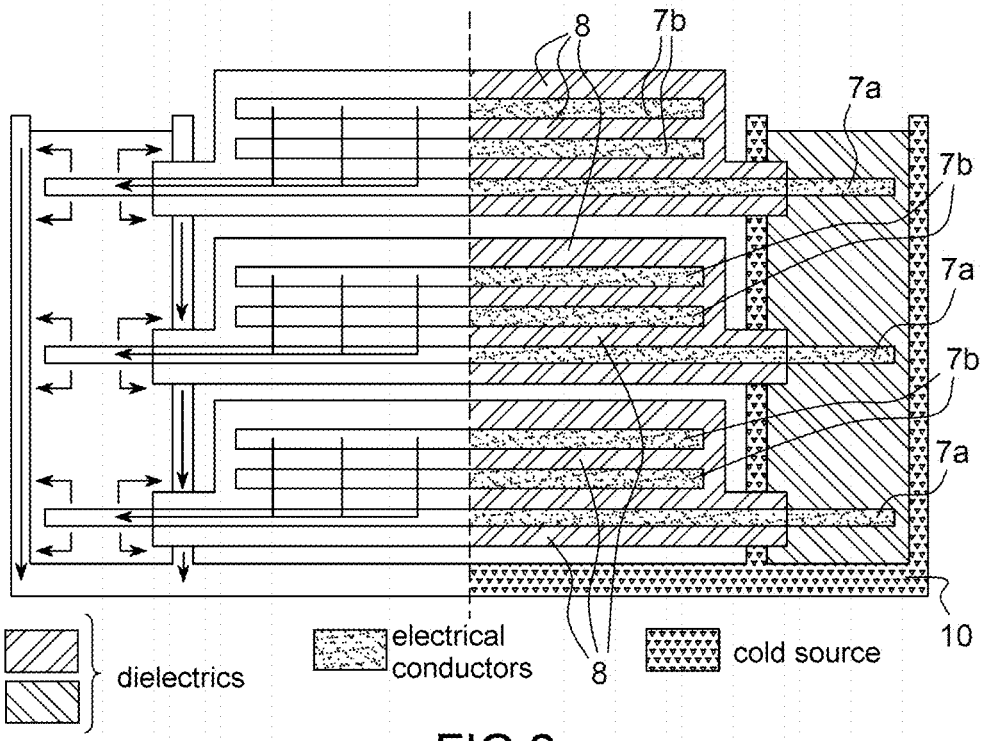
FIG. 2 schematically illustrates a planar transformer according to one aspect of the invention.

FIG. 2 represents a planar transformer according to one aspect of the invention, in which an individual winding 6 comprise one or more layers of copper 7 of which at least one 7*a* performs the thermal function. These layers of copper 7 are electrically insulated for example by a dielectric insulation 8. In this particular case an individual winding or individual assembly 6 comprises, for example, a layer 7*a* performing the thermal function, and two others 7*b*, conventional, not performing it.

The left-hand part of FIG. 2 represents, by arrows, the diffusion of the thermal energy in the planar transformer by the layers 7*a*, of which a part is surrounded by a dielectric 9 in proximity to a cold source 10. Thus, a continuous thermal path, or heat sink, is created between the windings 6 and the cold source 10. The thermal efficiency of the cold source 10 plays an important role in obtaining the final efficiency of the transformer.

The reduction of thermal resistance of the electrical conductors of the transformer makes it possible to significantly increase (more than double) the transferred power, despite an electrical output voltage multiplied by five, without increasing the volume occupied by the transformer.

Figure 3:
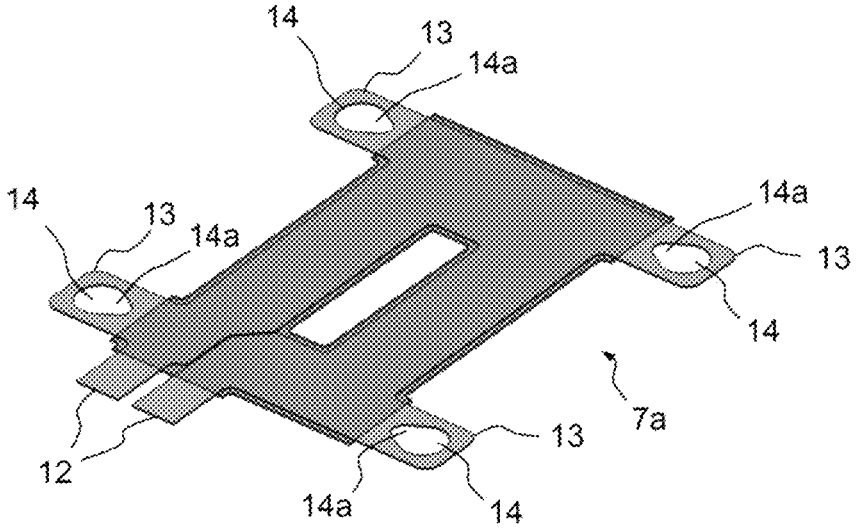
FIGS. 3 and 4 schematically illustrate a planar transformer layer according to two aspects of the invention.

FIG. 3 shows a planar transformer layer 7*a* comprising distinct electrical connections 12 and thermal connections 13.

The thermal connections 13, in this case four of them per layer 7*a*, comprise a hole 14, making it possible to fixedly hold together a plurality of layers 7*a*.

For example, the holes 14 of the thermal connections 13 can comprise an extension 14*a* towards the interior of the layer 7*a*. These extensions 14*a* make it possible to locally maximize the heat flux towards the cold source to do so given the constraint of a mechanical fixing of the transformer by means of screws.

Figure 4:
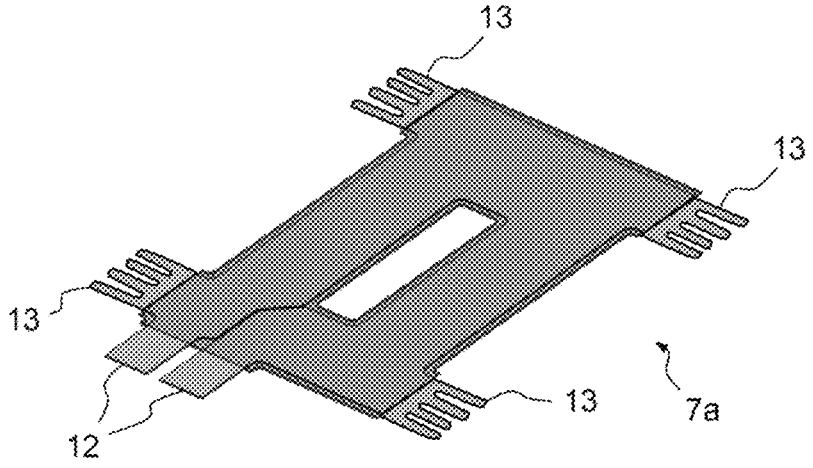

As a variant, as illustrated in FIG. 4, the thermal connections can be comb-shaped, and thus without holes, which makes it possible to adapt to another transformer fixing means.

Any other type of distinct thermal connection can of course be envisaged, regardless of its shape, that makes it possible, by means of another element, to fixedly link a stacking of layers or of assemblies of layers.

Hereinafter in the description, in a nonlimiting manner, only thermal links 13 with holes 14 will be described.

The rest of the description illustrates an exemplary embodiment of the invention.

The winding production technology is based on flexible circuits made up of an electrical circuit on a layer encapsulated between two flexible insulation layers.

The windings produced are then stacked.

Figure 5:
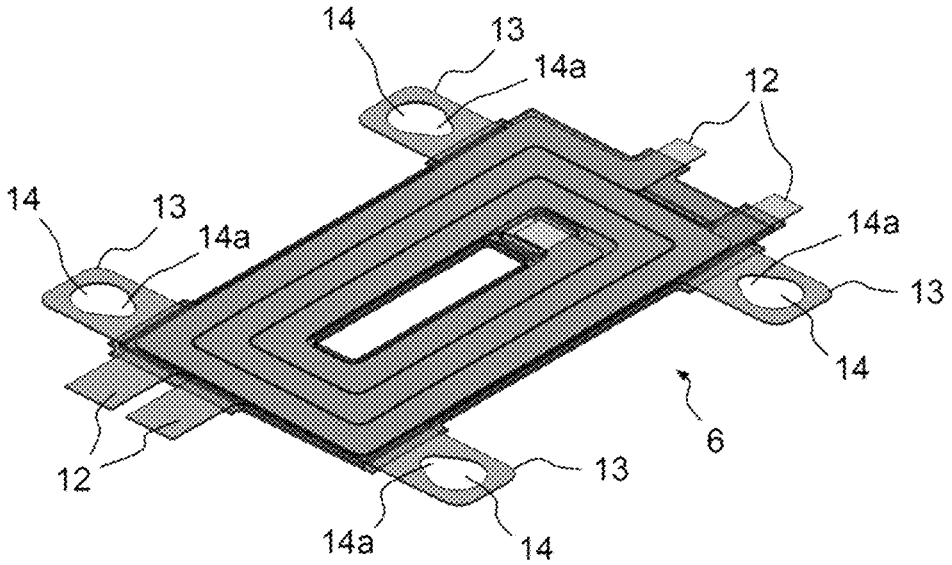
FIGS. 5 to 11 schematically illustrate an embodiment of a transformer according to one aspect of the invention.

As illustrated in FIG. 5, in order to easily perform the assembly of a transformer, it is possible to produce an assembly comprising, for example, a planar transformer layer 7*a* comprising distinct electrical connections 12 and thermal connections 13 and two conventional planar transformer layers 7*b*, directly by the manufacturer of the circuit in order to obtain an individual winding or assembly of layers.

Figure 6:
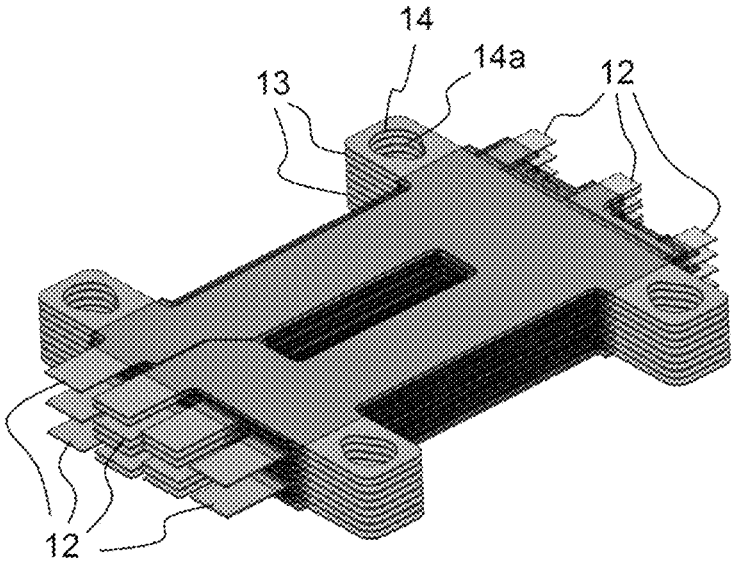

FIG. 6 represents a stack of a plurality of assemblies of layers according to FIG. 5, which constitutes the assembly of the windings of the transformer according to an aspect of the invention.

In order to drain the heat flux leaving the primary turns or, in other words, the turns or layers 7*a*, it is necessary to create a continuous path to the flat base of the transformer.

The assembly of the transformer is performed as follows.

Figure 7:
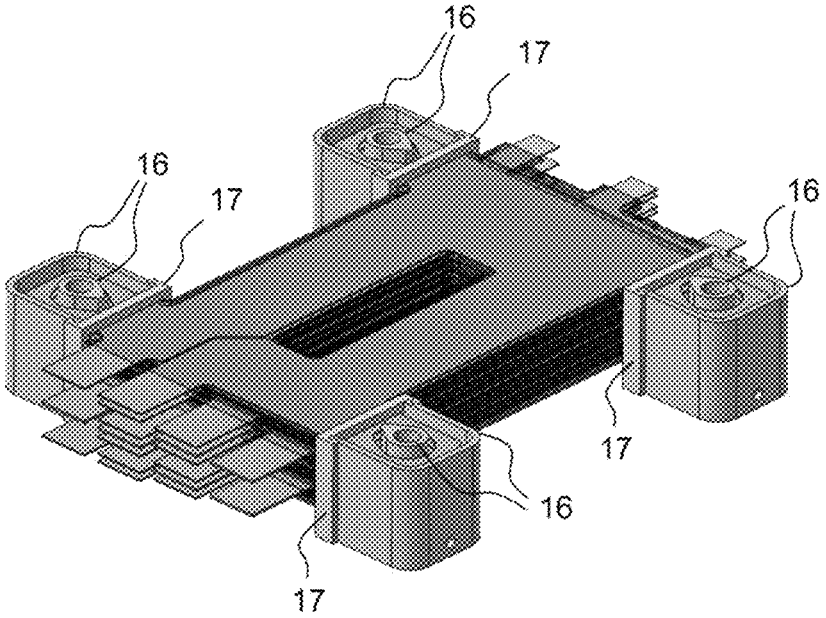

As illustrated in FIG. 7, after having stacked assemblies of individual layers or windings 6 on a rig, the four heat-sinking placements, here disposed in proximity to the corners, are closed by means of capping pieces made of aluminium 16 and a comb of dielectric material 17. These pieces 16 and 17 play a role of sealing and reproducibility of the stacking. Once this operation is finished, the feet of the transformer which extend the exchange to the cold plate or cold source 10, are slipped. In effect, in the proposed assembly, there is a break in the link between the transformer and the cold source. More generally, this function could directly form part of the cold source which would have the effect of further improving the thermal efficiencies.

Figure 8:
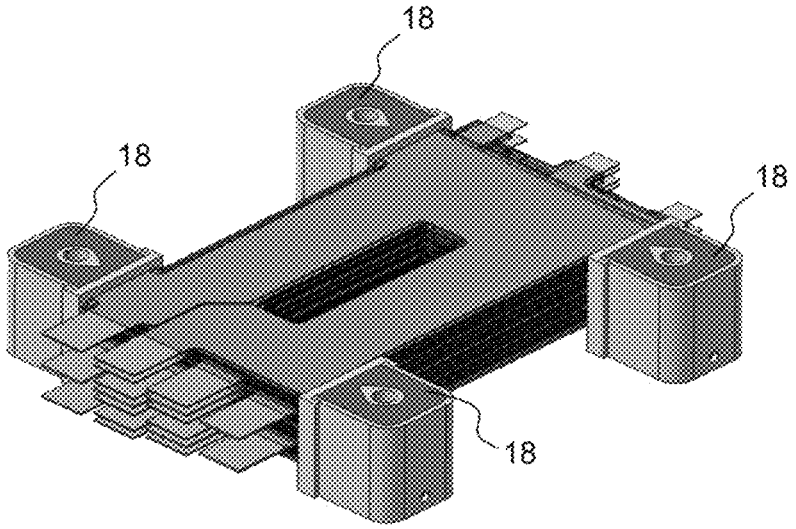
Figure 9:
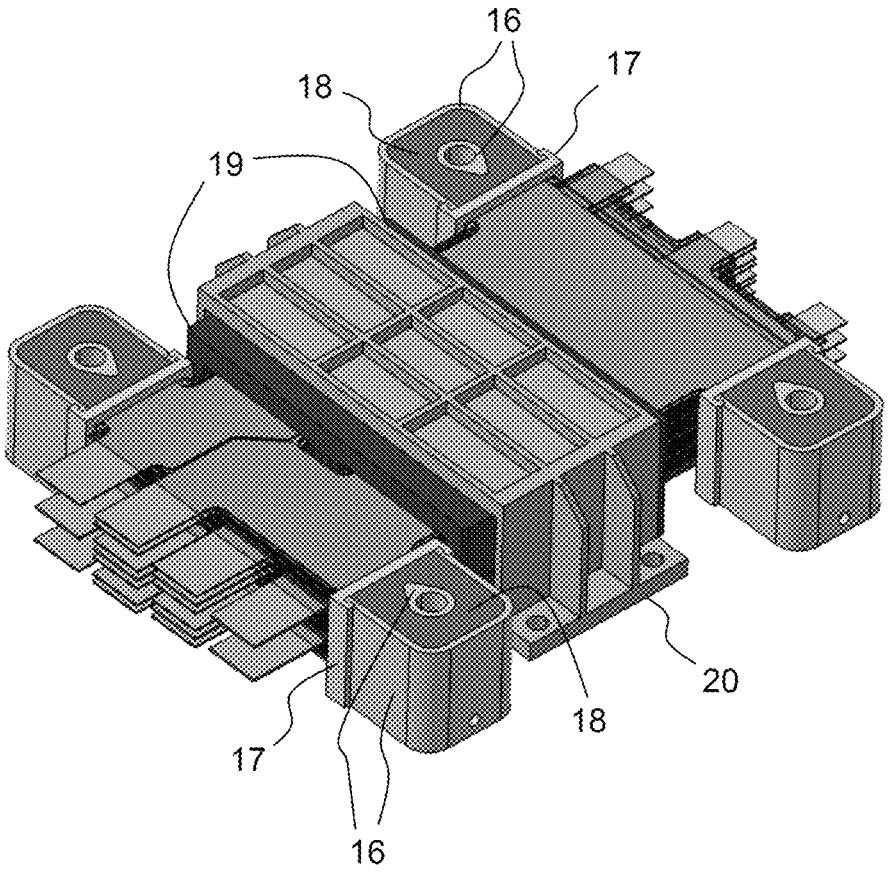

Next, as illustrated in FIG. 8, the four feet 16, 17 of a dielectric resin 18 have a good thermal conductivity. The design takes into account the voltages involved between the individual windings 6 in order to guarantee the electrical insulation.

Finally, ferrite cores 19 (magnetic cores) are placed around the winding made up of the stacking of the individual windings 6. The present transformer proposes completely decoupling the heat flux from the losses by the copper 6 and from the losses by the irons 19. Consequently, the ferrites 19 are held mechanically by a piece 20, for example made of aluminium, also serving as a heat sink to the flat base.

Figure 10:
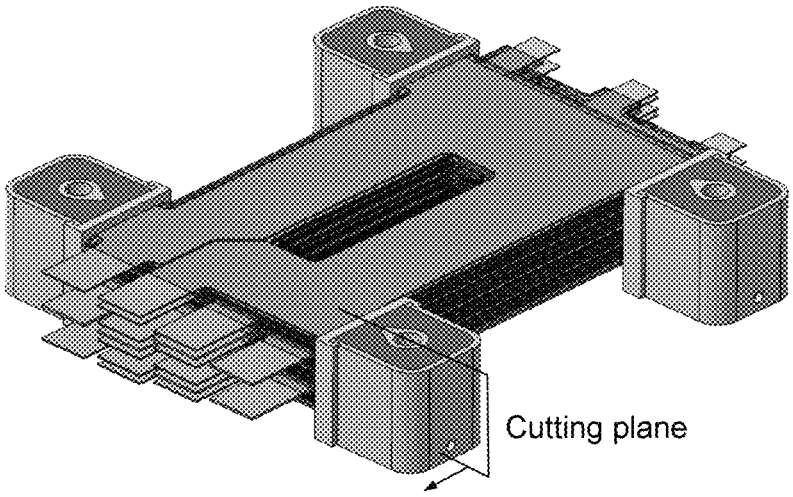
Figure 11:
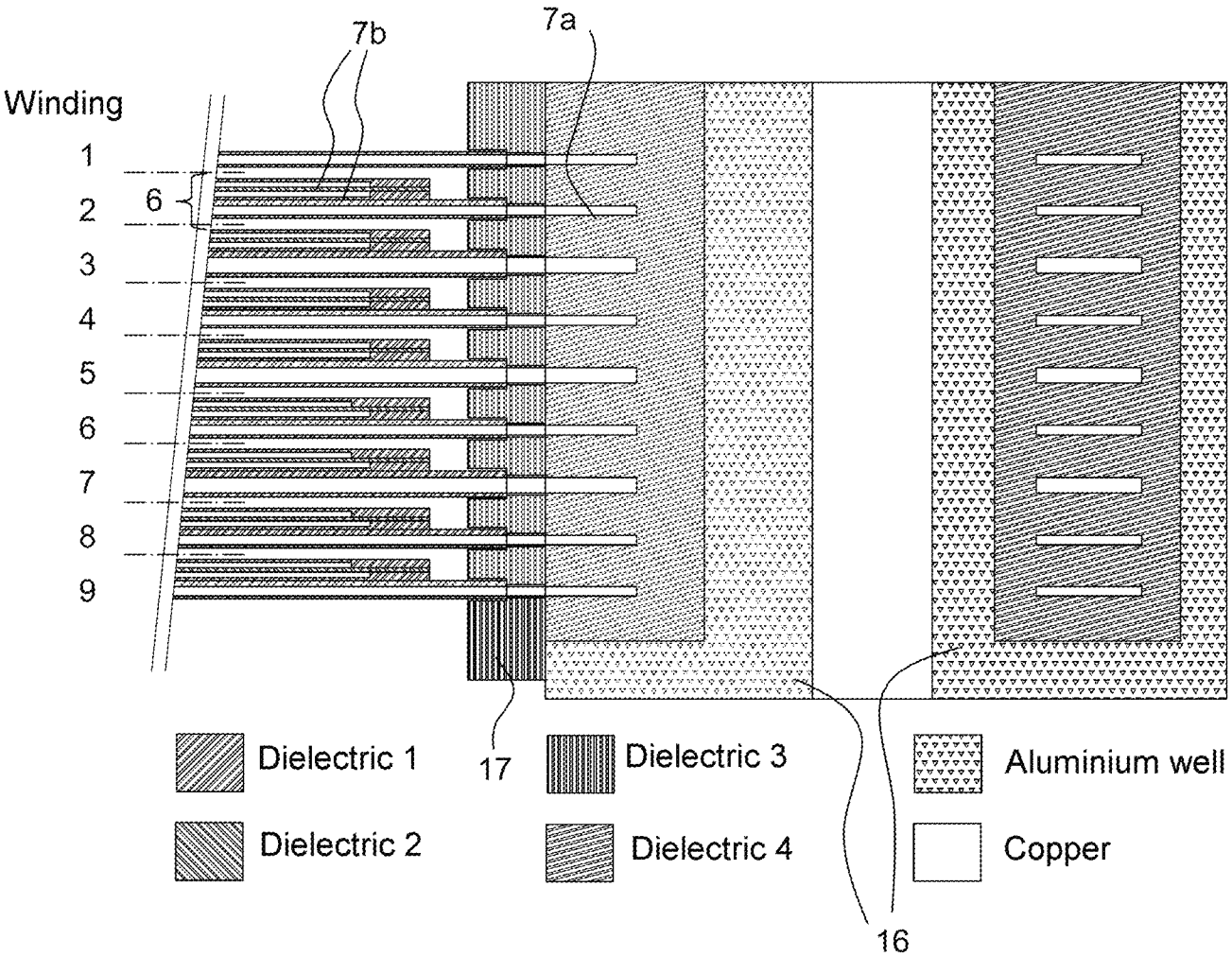

FIG. 10 shows the cutting plane of FIG. 8 to obtain the cross-sectional view of FIG. 11.

The invention claimed is:

1. An assembly of layers comprising a plurality of primary planar transformer layer turns of windings, each of the primary planar transformer layer turns of windings comprising distinct electrical connections and thermal connections having a hole in primary layers, the hole with an extension towards an interior of the layer based on a top view to locally maximize the heat flux towards a heat sink, wherein the extension is narrower than the hole.

2. The planar transformer layer according to claim 1, wherein a thermal connection of the thermal connections is comb-shaped.

3. The assembly of layers of claim 1, further comprising:

a plurality of secondary planar transformer layers without distinct electrical and thermal connections, wherein the secondary planar transformer layers are separated from the primary planar layer turns of windings and covered by a dielectric material, except for the thermal connection or connections of the plurality primary planar transformer layers.

4. A planar transformer comprising at least one assembly of layers including:

plurality of primary planar transformer layer turns of windings, each of the primary planar transformer layer turns of windings comprising distinct electrical connections and thermal connections having a hole in primary layers, the hole with an extension towards an interior of the layer based on a top view to locally maximize the heat flux towards a heat sink, wherein the extension is narrower than the hole; and a plurality of secondary planar transformer layers without distinct electrical and thermal connections, wherein the secondary planar transformer layers are separated from the primary planar transform layer turns and covered by a dielectric material, except for the thermal connection or connections of the plurality primary planar transformer layers.

5. The planar transformer according to claim 4, wherein a plurality of assemblies stacked one on top of the other, in which the thermal connections of the primary layers are connected to a heat sink.

6. The planar transformer according to claim 5, wherein the heat sink comprises a cold source and a dielectric part.

7. The planar transformer according to claim 6, wherein the cold source is arranged on the outer part of the heat sink, surrounding the dielectric part.

8. The planar transformer according to claim 5, further comprising a magnetic core and an associated fixing element.

9. The planar transformer according to claim 1, wherein the extension extends only towards the interior of the layer.

* * * * *